United States Patent [19]

Toda et al.

[11] 4,120,214

[45] Oct. 17, 1978

[54] EXHAUST GAS RECIRCULATION SYSTEM

[75] Inventors: Yoshio Toda, Yokohama; Yoshio Iwasa, Nagareyama, both of Japan

[73] Assignee: Nissan Motor Company, Limited, Japan

[21] Appl. No.: 718,967

[22] Filed: Aug. 30, 1976

[30] Foreign Application Priority Data

Dec. 22, 1975 [JP] Japan ..... 50-153172

[51] Int. Cl.[2] ..... F02M 25/06; F02B 33/00

[52] U.S. Cl. ..... 74/860; 123/119 A; 74/859

[58] Field of Search ..... 123/119 A; 74/860, 859

[56] References Cited

U.S. PATENT DOCUMENTS

| | | | |
|---|---|---|---|
| 3,915,035 | 10/1975 | Chana | 74/859 |
| 3,978,834 | 9/1976 | Arnaud et al. | 123/119 A |
| 4,008,697 | 2/1977 | Kono | 123/119 A X |
| 4,016,853 | 4/1977 | Bible | 123/119 A |

*Primary Examiner*—Wendell E. Burns

[57] ABSTRACT

An EGR control valve is closed by admitting atmospheric air into a vacuum chamber of an actuator thereof or by reducing or stopping the admission of intake passageway vacuum into the vacuum chamber when a transmission of the motor vehicle is in a top gear and a higher gear, when the temperature of the engine is below a predetermined value, and when the transmission is in a top gear and a higher gear and the degree of opening of the throttle valve is above a predetermined value.

6 Claims, 7 Drawing Figures

EXHAUST GAS RECIRCULATION SYSTEM

The present invention relates generally to an exhaust gas recirculation (EGR) system for an internal combustion engine and particularly to an EGR system of this type which is provided with means for reducing or stopping the supply of exhaust gas into an intake system of the engine when the engine is running at a high speed and/or at a high load.

As is well known in the art, an internal combustion engine is provided with an exhaust gas recirculation (EGR) system which feeds a part of exhaust gas of the engine into an intake passageway for limiting the temperature of combustion in a combustion chamber below a predetermined level to reduce the amount of nitrogen oxides (NOx) produced by combustion of an air-fuel mixture in the combustion chamber. In this instance, as the amount of exhaust gas fed into the intake passageway is increased, the fuel consumption of the engine is increased and the operational performance of the engine is degraded although the production of nitrogen oxides is reduced. Thus, the EGR system is provided with an EGR control valve which is disposed in an EGR passageway and is operated by the vacuum in the intake passageway to control the amount of exhaust gas fed thereinto in accordance with an operating condition of the engine. However, it is desirable to reduce or stop the supply of exhaust gas into a combustion chamber of the engine when the engine is running at a high speed and at a high load. This is to prevent the power produced by the engine from being reduced and the fuel consumption of the engine from being increased.

It is, therefore, an object of the invention to provide an EGR system which comprises means for closing an EGR control valve to reduce or stop the supply of exhaust gas into a combustion chamber of the engine by feeding atmospheric air into a vacuum chamber of the EGR control valve when a transmission of the vehicle is in a predetermined high speed gear or gears.

This and other objects and advantages of the invention will become more apparent from the following detailed description taken in connection with the accompanying drawings in which.

Figure 1:
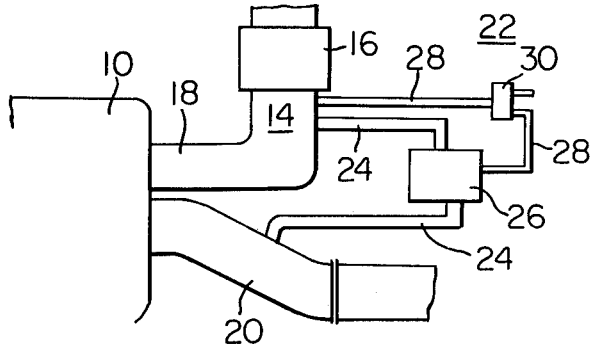
FIG. 1 is a schematic view of the relationship of an exhaust gas recirculation (EGR) system according to the invention and an internal combustion engine.

Referring to FIG. 1 of the drawings, there is shown an internal combustion engine 10 for a motor vehicle and an exhaust gas recirculation (EGR) system according to the invention which is combined with the engine 10. The engine 10 is shown to include an intake passageway 14 for providing communication between the atmosphere and an intake port (not shown) of the engine 10, a carburetor 16 having a part of the intake passageway 14, an intake manifold 18 forming a part of the intake passageway 14, and an exhaust gas passageway 20 for providing communication between an exhaust port (not shown) of the engine 10 and the atmosphere.

The EGR system, generally designated by the reference numeral 22, comprises an exhaust gas recirculation (EGR) passageway 24 providing communication between the exhaust gas passageway 20 and the intake passageway 14 downstream of a throttle valve (not shown) or the intake manifold 18 and feeding into the intake passageway 14 a part of exhaust gas emitted from the engine 10, an exhaust gas recirculation (EGR) control valve 26 disposed in the EGR passageway 24, passage means 28 providing communication between an actuator (not shown) of the EGR control valve 26 and the intake passageway 14, and an actuator control device 30 disposed in the passage means 28.

Figure 2:
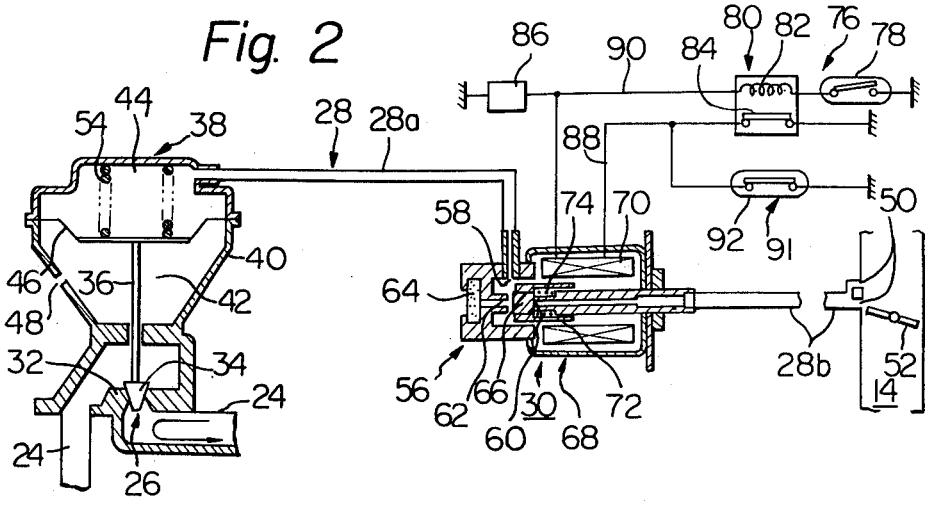
FIGS. 2 to 4 are schematic views of a first preferred embodiment of an EGR system according to the invention, which illustrate three kinds of different operational modes of the EGR system.
Figure 3:
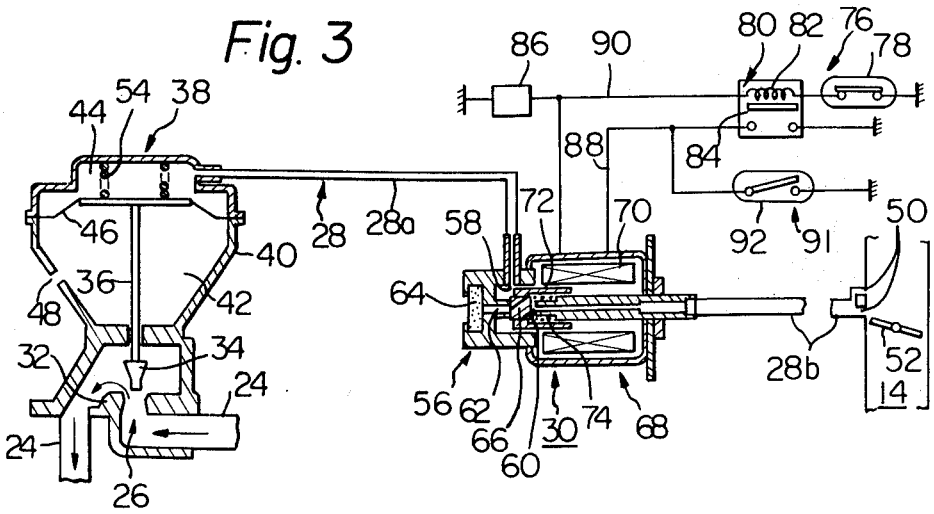
Figure 4:
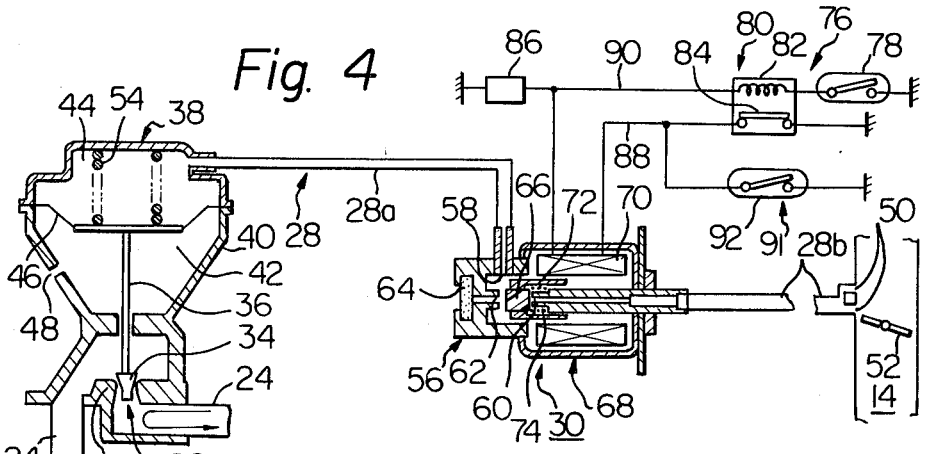

Referring to FIGS. 2 to 4 of the drawings, there is shown the detail of the EGR system 22. The EGR control valve 26 includes a valve seat 32 formed in the EGR passageway 24, a valve head 34 movably located with respect to the valve seat 32 to vary the effective cross sectional area of the EGR passageway 24 in accordance with an operating condition of the engine 10 to meter the amount of exhaust gas fed to the intake passageway 14, and a valve stem 36 extending from the valve head 34 externally of the EGR passageway 24. The actuator 38 is provided for operating the EGR control valve 26 and includes a housing 40 having first and second chambers 42 and 44, a flexible diaphragm 46 separating the chambers 42 and 44 from each other. The first chamber 42 communicates with the atmosphere through a vent port 48, while the second chamber 44 communicates with the passage means 28. The passage means 28 communicates with a vacuum taking-out port 50 opening into the intake passageway 14 at a place which is adjacent to the throttle valve 52 and which is varied from the upstream or atmosphere side of the throttle valve 52 into the donwstream or vacuum side thereof as the degree of opening of the throttle valve 52 increases. The passage means 28 conducts the vacuum in the intake passageway 14 at the place into the second chamber 44. A spring 54 is provided to urge the diaphragm 46 in a direction opposed by the atmospheric pressure in the first chamber 42. The chamber 42 is located between the valve head 34 and the diaphragm 46 so that the degree of opening of the EGR control valve 26 is increased and reduced in accordance with an increase and a decrease in the vacuum in the second chamber 44.

The actuator control device 30 serves to cause the actuator 38 to close the EGR control valve 26 when the vehicle is travelling with the transmission (not shown) thereof in a predetermined high speed gear or gears and when the temperature of the engine 10 is below a predetermined value irrespective of the gear or gear ratio conditions of the transmission. The actuator control device 30 comprises a three-way valve 56 disposed in the passage means 28 and alternatively communicating the second chamber 44 with the vacuum taking-out port 50 and with the atmosphere. The actuator control valve 56 comprises first and second ports 58 and 60 communicating respectively with the passages **28*a* and 28*b*, a third port 62 communicating with the atmosphere through an air filter 64, and a valve head 66 movable to alternatively provide communication between the passages 28*a* and 28*b* and between the passage 28*a* and the atmosphere. Operating means 68 is provided for operating the three-way valve 56 and is formed in this embodiment of solenoid means including a solenoid 70**, a valve stem 72 fixedly connected to the valve head 66 and forming a core of the solenoid 70 to be movable in response to energization and deenergization of the solenoid 70, and a return spring 74 urging the valve head 66 and the valve stem 72 into a position in which the valve head 66 provides communication between the passages 28*a* and 28*b*.

The valve stem 72 comprises a cylinder connected at one end to the valve head 66 and enclosing the second port 60 and the passage 28*b* to provide a clearance between the same and the cylinder and movably axially of the passage 28*b*. The spring 74 is located in the clearance. The valve head 66 is movable by the force of the spring 74 into a position to open the second port 60 and to close the third port 62 during deenergization of the solenoid 70 and by movement of the cylinder due to energization of the solenoid 70 into a position to open the third port 62 and to close the second port 60. The solenoid 70 is energized when the vehicle is travelling at a high speed or the transmission is in the predetermined high speed gear or gears and is deenergized when the vehicle is at a standstill and is travelling at a low speed or the transmission is in a non-driving position such as neutral and parking positions and is in driving gears lower than the predetermined high speed gear. The predetermined high speed gear is a fourth (top) gear in the case of a four speed transmission and is a top gear and higher gears in the case of a transmission provided with an overdrive gear system.

First sensing means 76 is provided to control the solenoid 70 in accordance with gear or speed conditions of the transmission and comprises in this embodiment, for example, a switch 78 and a relay 80 which are combined with each other. The switch 78 is closed when the transmission is in gear conditions other than the predetermined high speed gear and is opened when it is in the predetermined high speed gear. The relay 80 includes a coil 82 and a normally closed switch 84 which is opened when the coil 82 is energized. The switch 84 is electrically connected in series to an electric power source 86 such as a battery by way of the solenoid 70 to form an electric control circuit 88 therefor. The switch 78 is electrically connected in series to the electric power source 86 by way of the coil 82 to form an electric control circuit 90 for the switche 84 so that, when the switch 78 is closed, the coil 82 is energized. If, in lieu of the switch 78, a switch is employed which is included in the control circuit 88 and is closed when the transmission is in the predetermined high speed gear or gears, the relay 80 can be omitted.

The solenoid 70 is also energized when the temperature of the engine 10 is below a predetermined value such as, for example, 50° C. as before the engine 10 is warmed up independently of the gear or speed conditions of the transmission. For this purpose, second sensing means 91 is provided to sense the temperature of a coolant (not shown) of the engine 10 and comprises a switch 92 which is closed when the temperature of the coolant is below a predetermined value and which is opened when the coolant temperature is above the predetermined value. The switch 92 is electrically connected to the solenoid 70 in parallel with the switch 84 of the relay 80.

Figure 5:
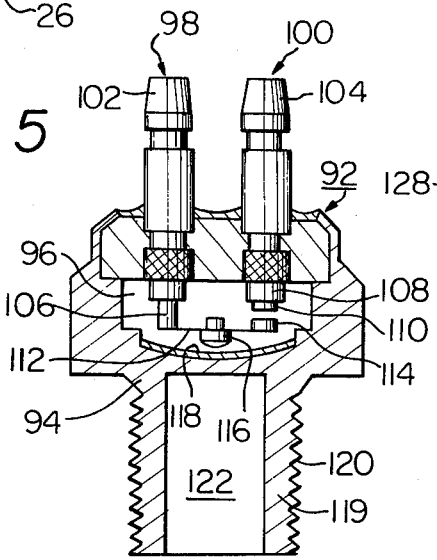
FIGS. 5 and 6 are schematic views of two examples of engine temperature sensing means forming a part of the EGR system shown in FIGS. 2 to 4.

Referring to FIG. 5 of the drawings, there is shown an example of the switch 92. As shown in FIG. 5, the switch 92 comprises a casing 92 made of a good heat conductive metal, for example, such as brass and formed therein with a switch chamber 96. First and second electric conductors 98 and 100 extend from the outside of the casing 94 into the switch chamber 96 and have first and second terminals 102 and 104 located externally of the casing 94 and ends 106 and 108 located in the switch chamber 96, respectively. A stationary contact 110 is fixedly mounted on the end 108 of the second conductor 100. An electric conductive arm 112 is fixedly connected at one end with the end 106 of the first conductor 98 and has a free end on which a movable contact 114 is fixedly mounted.to face the stationary contact 110 to be engageable with it. A projection or actuator 116 is fixedly secured on the arm 112 at its mid portion. A bimetal 118 is located in the switch chamber 96 to face the actuator 116. The casing 94 has a stem portion 119 formed in its external surface with a screw thread 120 which is threaded into passage means (not shown) of the engine coolant. The stem portion 119 is formed therein a bore 122 which extends toward the bimetal 118 but is separated from the switch chamber 96. The bore 122 serves to minimize the heat capacity of the casing 94 and is filled with the engine coolant to transmit the heat thereof to the bimetal 118 as quickly as possible when the switch 92 is connected to the passage means of the engine coolant. The bimetal 118 is bent toward the actuator 116 to engage it and to move the arm 112 into a position in which the movable contact 114 makes contact with the stationary contact 110 to close the switch 92 when the temperature of the engine coolant is below the predetermined value. The bimetal 118 is bent away from the actuator 116 and causes the arm 112 to return into a position in which the movable contact 114 is disengaged from the stationary contact 110 to open the switch 92 when the temperature of the engine coolant is above the predetermined value.

The EGR system 22 thus far described is operated as follows:

When the temperature of the engine 10 or the engine coolant is below the predetermined value such as, for example, 50° C. as before the engine 10 is warmed up, the switch 92 is closed to energize the solenoid 70 to cause the three-way valve 56 to obstruct communication between the first and second ports 58 and 60 and to provide communication between the first and third ports 58 and 62 irrespective of the gear or gear ratio conditions of the transmission as shown in FIG. 2. As a result, the atmospheric pressure is admitted into the vacuum chamber 44 to cause the EGR control valve 26 to block the EGR passageway 24. Thus, the supply of exhaust gas into the intake passageway 14 is ceased to facilitate the starting of the engine 10, to ensure the stability of operation of the engine 110 and to minimize time necessary for warming up the engine 10.

When the engine 10 is warmed up and the temperature of the engine coolant is above the predetermined value, the switch 92 is opened. At this state, when the transmission is in the gear conditions lower than the predetermined high speed gear, the switch 78 is closed to energize the relay coil 82 to open the switch 84 as shown in FIG. 3. As a result, the solenoid 70 is deenergized to cause the three-way valve 56 to block communication between the first and third parts 58 and 62 and to provide communication between the first and second ports 58 and 60. Accordingly, the vacuum in the intake passageway 14 is fed into the vacuum chamber 44 so that the EGR control valve 26 meters the amount of exhaust gas fed to the intake passageway 14 in accordance with the load condition of the engine 10 to minimize the production of nitrogen oxides (NOx) resulting from combustion in the engine 10.

At this state, when the transmission is in the predetermined high speed gear or gears so that the vehicle is travelling at a high speed, the switch 78 is opened to deenergize the relay coil 82 to close the switch 84 as shown in FIG. 4. As a result, the solenoid 70 is energized to cause the three-way valve 56 to provide communication between the first and third ports 58 and 62. Accordingly, the atmospheric air is admitted into the vacuum chamber 44 so that the EGR control valve 26 close the EGR passageway 24 to stop the supply of exhaust gas into the intake passageway 14 to make it possible for the engine 10 to provide a desired high power and to prevent an increase in fuel consumption of the engine 10.

Figure 6:
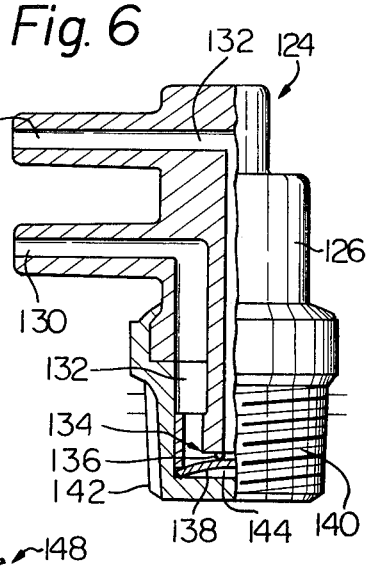
Figure 6:
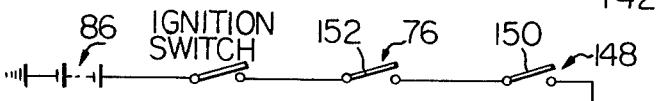

Referring to FIG. 6 of the drawings, there is shown an example of an actuator control device which can be employed in lieu of the switch 92. The actuator control device 124 is disposed in the passage means 28 and serves to directly allow and inhibit the supply of the intake passageway vacuum into the vacuum chamber 44 in accordance with the temperature of the engine 10 irrespective of the gear or gear ratio condition of the transmission. The actuator control device 124 comprises a casig 126 made of a good heat conductive material such as brass. The casing 126 includes first and second ports 128 and 130 and is formed therethrough with a passage 132 providing communication between the first and second ports 128 and 130. The casing 126 is disposed in the passage **28*b* in such a manner that one of the ports 128 and 130 communicates with the passage 28*b* on the three-way valve 56 side and the other port 128 or 130 communicates with the passage 28*b* on the intake passageway 14 side. A control valve 134 is disposed is the passage 132 and comprises a valve seat 136 formed in the passage 132, and a bimetal valve 138 which seats on and unseats from the valve seat 136. The casing 126 has a stem portion 140 formed in its external surface with a screw thread 142 which is threaded into passage means (not shown) of the engine collant. The stem portion 140 is formed therein with a valve chamber 144 forming a part of the passage 132 and containing the control valve 134. The bimetal valve 138 is bent toward the valve seat 136 to seat thereon to block the passage 132 to inhibit the supply of the intake passageway vacuum into the vacuum chamber 44 when the temperature of the engine coolant is below a predetermined value such as, for example, 50° C. and is bent away from the valve seat 136 to unseat therefrom to open the passage 132 to allow the supply of the intake passageway vacuum into the vacuum chamber 44 when the temperature of the engine coolant is above the predetermined value. The casing 126 may be disposed in the passage 28*a* in such a manner that one of the first and second ports 128 and 130 communicates with the passage 28*a* on the actuator 38 side and the other port 128 or 130 communicates with the passage 28*a* on the three-way valve 56** side.

When the engine 10 is employed for a motor vehicle travelling at a high load a relatively much time as a vehicle travelling a mountain zone, the actuator control device 124 may be connected with the passage **28*a* in such a manner that one of the ports 128 and 130 opens into the atmosphere and the other port 128 or 130 communicates with the passage 28*a*. In this instance, the threshold value of the bimetal valve 138 is relatively high and is, for example, 95° C. The bimetal valve 138 is bent toward the valve seat 136 to seat thereon to inhibit the supply of atmospheric air into the passage 28*a* from the passage 132 when the temperature of the engine coolant is below a predetermined value such as 95° C. The bimetal valve 138 is bent away from the valve seat 136 to open the passage 132 when the temperature of the engine coolant is above the predetermined value so that atmospheric air is admitted into the vacuum chamber 44 through the passage 132. As a result, the amount of exhaust gas fed into the intake passageway 14 is reduced or rendered zero to increase the power produced by the engine 10 and to even if the transmission is in gears lower than the predetermined high speed gear or gears when the engine 10** is running at a high load.

Figure 7:
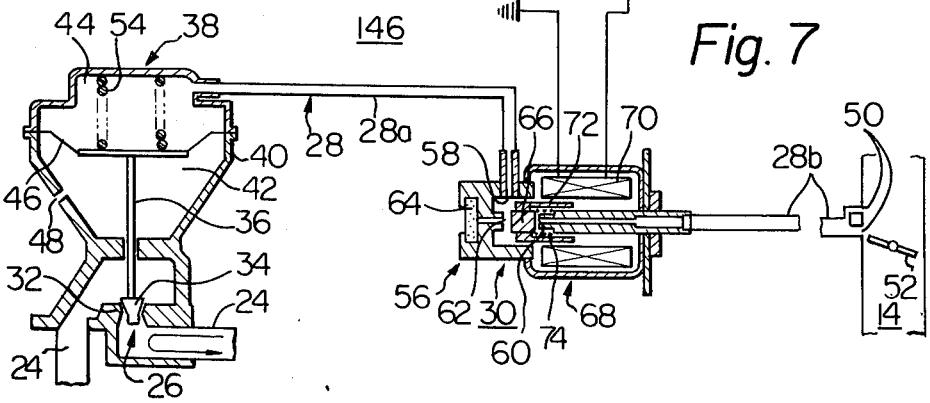
FIG. 7 is a schematic view of a second preferred embodiment of an EGR system according to the invention.

Referring to FIG. 7 of the drawings, there is shown a second preferred embodiment of an EGR system according to the invention. The EGR system 146 shown in FIG. 7 is characterized in that an electric control circuit for the solenoid 70 includes third sensing means 148 connected in series to the first sensing means 76. The third sensing means 148 serves to control the solenoid 70 in accordance with the degree of opening of the throttle valve 52 and comprises a normally open switch 150 which is closed when the degree of opening of the throttle valve 52 is above a predetermined valve such as, for example, 60% of full opening thereof. The first sensing means 76 comprises in this embodiment a transmission switch 152 which is closed only when the transmission is in the predetermined high speed gear or gears. The solenoid 70 is energized only when both of the switches 150 and 152 are concurrently closed to admit atmospheric air into the vacuum chamber 44 to cause the actuator 38 to close the EGR control valve 26.

Thus, since when a motor vehicle is travelling in a gear ratio lower than a predetermined value or in a top gear and a higher gear with an engine provided with the EGR system 146 and running at a relatively high load ad travel in the suburbs, the EGR control valve 26 stops the supply of engine exhaust gas into the intake passageway 14, the EGR control valve 26 and the EGR passageway 24 are prevented from being overheated, cracked and burned. Furthermore, in this instance, since heat conducted to the carburetor 16 is reduced, deviation of the air-fuel ratio of the air-fuel mixture provided by the carburetor 16 from a desired air-fuel ratio is considerably reduced. Also, since when the vehicle is travelling in a gear ratio higher than the predetermined value or in a gear lower than a top gear with the engine running at a relatively low load as travel in the urban zones, the EGR control valve 26 allows the supply of engine exhaust gas into the intake passageway, the production of nitrogen oxides is effectively reduced.

It is possible to continue to reduce the production of nitrogen oxides (NOx) to a certain degree in the early stage of the time when the transmission become a top gear and a higher gear by selecting the cross sectional area of the port 62 to a suitable value or providing an orifice in the port 62 to make movement of the EGR control valve 26 into its fully closed position slow to gradually reduce the amount of engine exhaust gas fed into the intake passageway when the port 62 is opened by the actuator control valve 56. It will be appreciated that the invention provides an EGR system comprising means for closing an EGR control valve when a transmission provides a gear ratio lower than a predetermined value so that when a motor vehicle is travelling in a gear lower than a top gear as travel in the urban zones, the EGR control valve controls the amount of engine exhaust gas fed into an intake system to a proper value to effectively reduce the production of nitrogen oxides (NOx), and when the vehicle is travelling in a top gear and a higher gear as travel in the suburbs, the EGR control valve is closed to make zero the amount of engine exhaust gas fed into the intake system to make it possible for the engine to produce a desired high power and to reduce fuel consumption of the engine, and furthermore since when the vehicle is travelling with the engine running at a high speed, the supply of engine exhaust gas into the intake system is reduced or stopped, the occurrence of misfire is prevented to surely prevent a catalyst of a catalytic converter of the engine from being burned even if a throttle valve is closed to its idling position.

It will be also appreciated that the EGR system is provided with means for reducing or stopping the supply of the intake passageway vacuum into the actuator of the EGR control valve when the temperature of the engine is below a predetermined value so that the supply of engine exhaust gas into the intake system is reduced or stopped during warming up the engine to stabilize the operation of the engine and to rduce time necessary for warming up the engine.

What is claimed is:

1. An exhaust gas recirculation system for an internal combustion engine for a motor vehicle, comprising an exhaust gas recirculation (EGR) passageway for feeding exhaust gas of said engine into an intake passageway thereof, an exhaust gas recirculation (EGR) control valve disposed in said EGR passageway to meter in accordance with an operating condition of said engine the amount of said engine exhaust gas passing through said EGR passageway, an actuator for operating said EGR control valve to control the degree of opening of said EGR control valve to vary the effective cross sectional area of said EGR passageway in accordance with the vacuum prevailing in said intake passageway, and means for causing said actuator to close said EGR control valve when a transmission of said vehicle provides a gear ratio lower than a predetermined value, said actuator includes a vacuum chamber fed with the vacuum in said intake passageway adjacent to a throttle valve rotatably mounted therein, a flexible diaphragm operatively connected to said EGR control valve to operate it in response to the vacuum in said vacuum chamber, and passage means for feeding into said vacuum chamber said vacuum in said intake passageway, and the first-mentioned means comprises an actuator control valve disposed in said passage means and having a port communicating with the atmosphere, said actuator control valve having and being movable between a first position for closing said port and for allowing the supply of said intake passageway vacuum into said vacuum chamber and a second position for stopping the supply of said intake passageway vacuum into said vacuum chamber and for providing communication between said vacuum chamber and said port to admit atmospheric air into said vacuum chamber to cause said diaphragm to close said EGR control valve, operating means for alternatively moving said actuator control valve into said first and second positions, and first control means responsive to a gear ratio provided by said transmission which ratio is higher than a predetermined value to cause said operating means to move said actuator control valve into said first position and to a gear ratio provided by said transmission which ratio is lower than said predetermined value to cause said operating means to move said actuator control valve into said second position.

second control means responsive to a temperature of said engine below a predetermined value to close said passage means to cause said actuator to close said EGR control valve irrespective of gear ratio conditions of said transmission, operating means comprising a solenoid which has a core operatively connected to said actuator control valve and causes said actuator control valve to move into said first position when deenergized and to move into said second position when energized, and said first control means comprises first switch means which is electrically connected to said solenoid and is normally opened to deenergize said solenoid and is closed to energize said solenoid in response to said gear ratio lower than said predetermined value, and said second control means comprises second switch means which is electrically connected to said solenoid in parallel with said first switch means and is normally opened to deenergize said solenoid and is closed to energize said solenoid in response to a temperature of said engine below said predetermined value.

2. An exhaust gas recirculation system as claimed in claim 1, in which said first switch means comprises a switch closed in response to said gear ratio higher than said predetermined value and opened in response to said gear ratio lower than said predetermined value, a relay coil electrically connected to said switch and energized when said switch is closed, and a normally closed switch which is electrically connected to said solenoid to energize it when closed and is opened to deenergize said solenoid when said relay coil is energized.

3. An exhaust gas recirculation system as claimed in claim 1, in which said second switch means comprises a casing made of a good heat conductive material and formed therein with a switch chamber, first and second electric conductors having first and second terminals both located outside said casing, and first and second internal ends both located inside said switch chamber, an electric conductive arm fixedly secured at an end to said first internal end and having a free end facing said second internal end, stationary and movable contacts fixedly secured respectively to said second internal end and said free end and engageable with each other, an actuating member mounted on said arm at its mid portion, a bimetal located in said switch chamber to face said actuating member and bent in response to a temperature of a coolant of said engine below a predetermined value to engage said actuating member to move said arm into a position in which said movable contact makes contact with said stationary contact and bent away from said actuating member in response to a temperature of said engine coolant above said predetermined value to cause said arm to move into a position in which said movable contact is disengaged from said stationary contact, and a stem portion for sensing the temperature of said engine coolant and formed therein with a bore which extends toward said switch chamber and into which said engine coolant is admitted to transmit heat of said engine coolant to said bimetal.

4. An exhaust gas recirculation system for an internal combustion engine of a motor vehicle, comprising an exhaust gas recirculation (EGR) passageway for feeding exhaust gases of the engine into an intake passageway thereof, an exhaust gas recirculation (EGR) control valve operatively disposed in said EGR passageway for performing a first function of controlling the effective cross sectional area of said EGR passageway in accordance with an operating condition of the engine and a second function of closing said EGR passageway when it is desired to do so, means defining a fluid chamber, first passage means for providing communication between said fluid chamber and the intake passageway at a location adjacent to a throttle valve rotatably mounted therein, a flexible diaphragm having on a side thereof said fluid chamber and operatively connected to said EGR control valve for causing it to alternatively perform said first and second functions in accordance with the pressure of fluid in said fluid chamber, second passage means providing communication between said first passage means and the atmosphere, a second control valve for controlling communication between said fluid chamber and the atmosphere through said second passage means, said second control valve having a first position for obstructing the last-mentioned communication for causing said EGR control valve to perform said first function, and a second position for providing said last-mentioned communication for causing said EGR control valve to perform said second function, solenoid means for moving said second control valve alternatively into said first and second positions, first switch means electrically connected to a solenoid of said solenoid mmeans for causing said solenoid means to move said second control valve into said first position in response to a gear ratio provided by the transmission which ratio is higher than a predetermined value and for causing said solenoid means to move said second control valve into said second position in response to a gear ratio provided by the transmission which ratio is lower than said predetermined value, and second switch means electrically connected to said solenoid of said solenoid means in parallel with said first switch means for causing said solenoid means to move said second control valve into said second position in response to temperatures of the engine below a predetermined level irrespectively of gear ratios provided by the transmission.

5. An exhaust gas recirculation system as claimed in claim 4, in which said second control valve is disposed in said first passage means for providing communication between said fluid chamber and the intake passageway through said first passage means when said second control valve is in said first position and for obstructing the last-mentioned communication when said second control valve is in said second position.

6. An exhaust gas recirculation system as claimed in claim 5, further comprising control means for increasing the pressure of fluid in said fluid chamber for causing said EGR control valve to perform said second function irrespectively of gear ratios provided by the transmission.

* * * * *